US012789951B2

(12) United States Patent
Nesse et al.

(10) Patent No.: US 12,789,951 B2
(45) Date of Patent: Nov. 10, 2026

(54) DAVIT DEVICE

(71) Applicant: Vestdavit Gruppen AS, Laksevåg (NO)

(72) Inventors: Alexander Nesse, Bergen (NO); Atle Kalve, Hordvik (NO)

(73) Assignee: Vestdavit Gruppen AS, Laksevåg (NO)

( * ) Notice: Subject to any disclaimer, the term of this patent is extended or adjusted under 35 U.S.C. 154(b) by 580 days.

(21) Appl. No.: 18/276,990

(22) PCT Filed: Feb. 11, 2022

(86) PCT No.: PCT/EP2022/053352
§ 371 (c)(1),
(2) Date: Aug. 11, 2023

(87) PCT Pub. No.: WO2022/171789
PCT Pub. Date: Aug. 18, 2022

(65) Prior Publication Data

US 2024/0116602 A1 Apr. 11, 2024

(30) Foreign Application Priority Data

Feb. 12, 2021 (NO) ..... 20210184

(51) Int. Cl.
*B63B 23/26* (2006.01)
*B63B 23/40* (2006.01)

(52) U.S. Cl.
CPC ..... *B63B 23/26* (2013.01); *B63B 23/40* (2013.01)

(58) Field of Classification Search
CPC ..... B63B 23/00; B63B 23/02; B63B 16/26; B63B 23/26; B63B 23/30; B63B 23/40;
(Continued)

(56) References Cited

U.S. PATENT DOCUMENTS 3,778,855 A * 12/1973 Kariagin ..... B63B 23/26 212/292
4,364,326 A * 12/1982 Pike ..... B63B 23/62 114/372

(Continued)

FOREIGN PATENT DOCUMENTS

CN 101786489 A 7/2010
CN 102464089 A 5/2012

(Continued)

OTHER PUBLICATIONS

Kalve, Atle, U.S. Appl. No. 18/276,969, Applicant Vestdavit Gruppen AS, filed Aug. 11, 2023.

(Continued)

*Primary Examiner* — Daniel V Venne
(74) *Attorney, Agent, or Firm* — Bradley Arant Boult Cummings LLP

(57) ABSTRACT

A davit arrangement for launching and storing one or more boats or cargo devices, comprising—a carrier construction (1, 2) slidingly connected to a rail construction (3), said rail construction (3) is adapted to be fixedly attached to a roof or other overhanging construction (9), —a davit arm (6) arranged slidingly connected to the carrier construction (1, 2), said davit arm (6) is adapted to move between a launching position where the davit arrangement is adapted to hoist the boat or cargo device (A, B) to or from the sea surface, and an intermediate position where the boat is retracted into a position within the carrier construction (1, 2) of the davit arrangement, —a cylinder arrangement (4) is connected to the carrier construction (1, 2) at a point (4*a*) and connected to the rail construction (3) at an end (4*b*), said cylinder arrangement (4) is adapted to move the carrier construction (1, 2) between the intermediate position and a storage position where the boat or cargo device (A, B) is adapted to be stored, said davit arm (6) and cylinder arrangement (4) is
(Continued)

adapted to extend in laterally opposite directions. The invention further relates to a method for transporting one or more boats or cargo devices to/from a parking area from/to a sea surface.

10 Claims, 10 Drawing Sheets

(58) Field of Classification Search
CPC ..... B63B 23/48; B63B 35/00; B63B 35/40; B63B 13/005; B63B 13/02; B66C 11/08
USPC ..... 114/365, 368, 369, 370; 414/137.1
See application file for complete search history.

(56) References Cited

U.S. PATENT DOCUMENTS

| | | | | |
|---|---|---|---|---|
| 4,406,244 | A * | 9/1983 | Buchan | B63B 23/34 114/368 |
| 6,626,126 | B1 * | 9/2003 | Kalve | B63B 23/26 114/368 |
| 6,672,242 | B2 * | 1/2004 | Webb | B63B 23/10 114/368 |
| 8,813,549 | B1 * | 8/2014 | Pao | B63B 23/58 114/365 |

FOREIGN PATENT DOCUMENTS

| | | | |
|---|---|---|---|
| CN | 206797653 | U | 12/2017 |
| CN | 208053576 | U | 11/2018 |
| JP | S51100590 | A | 9/1976 |
| JP | H10250682 | A | 9/1998 |
| JP | 2006281887 | A | 10/2006 |
| KR | 101833987 | B1 | 3/2018 |
| KR | 101880730 | B1 | 7/2018 |
| NO | 311249 | B1 | 11/2001 |
| NO | 325214 | B1 | 2/2008 |
| WO | WO-9910229 | A1 | 3/1999 |

OTHER PUBLICATIONS

Patent Cooperation Treaty, International Application No. PCT/EP2022/053352, International Search Report, mailed Feb. 6, 2022, 2 pages.

* cited by examiner

DAVIT DEVICE

TECHNICAL FIELD

The present invention relates to a davit arrangement adapted to lift and move one or more boats from a storage position into a launch position, and vice versa. More specifically, the invention relates to an arrangement for handling and storing several boats utilizing the davit arrangement.

BACKGROUND ART

Known method for davit arrangements includes arranging the davit device at a height substantially above the deck of the ship, so that it is possible to secure a relatively free deck space under the davit device.

The publications JP4568632, NO325214, NO311249, JPS 51-100590, CN206797653 relates to prior art davit devices for launching boats from a vessel, platform or similar device.

However, the known davit devices have a hoisting device that is extendable in a telescope part by a carrier arm that may be moved in a groove in a stationary secured telescope part.

The known davit devices however do not provide any solution to hoist/launch and park more than one boat subsequently in one operation The invention provides an arrangement and method for easily launch of two or more boats or cargo devices, for instance lifeboats within the same davit arrangement, where the second boat or cargo device B (innermost boat) are handled directly from the storage position.

The arrangement is further developed to quickly and easily launch/hoist two or more boats by the same davit arrangement with a two-point davit system or a one-point davit system, without the necessity to unhitch or rearrange the boats or cargo devices in the process.

It is thus not necessary to have carriers or rails to facilitate the movement of the boats in a storage area beneath the davit arrangement with the arrangement.

The arrangement may further be operated with a flush deck beneath the davits, which makes it possible to receive several boats, if necessary.

The arrangement may further reduce the steps from hoisting to storing or vice versa by directly position or retrieve the boat from the storage area before/after launching.

SUMMARY OF INVENTION

The invention related to ta davit arrangement for launching and storing one or more boats or cargo devices. The davit arrangement comprises a telescopic part having

- a carrier construction slidingly connected to a rail construction, said rail construction is adapted to be fixedly attached to a roof or other overhanging construction,
- a davit arm arranged slidingly connected to the carrier construction, said davit arm is adapted to move between a launching position where the davit arrangement is adapted to hoist the boat or cargo device to or from the sea surface, and an intermediate position where the boat or cargo device is retracted into a position within the carrier construction of the davit arrangement,
- a cylinder arrangement is connected to the carrier construction at one end and connected to the rail construction at the opposite end, said cylinder arrangement is adapted to move the carrier construction between the intermediate position and a storage position where the boat is adapted to be stored, said davit arm and cylinder arrangement is adapted to extend in laterally opposite directions.

This means that the davit arm and cylinder arrangement is extending in opposite directions along a horizontal plane extending in the longitudinal direction of the davit arm and cylinder arrangement. The extension is parallel with the longitudinal direction of the rail construction.

The cylinder arrangement is connected between the rail construction and the carrier construction in a way so that the cylinder arrangement is adapted to move the carrier construction with respect to the rail construction. In the embodiment shown this means that the outer cylinder is connected to the rail construction at a point and the innermost cylinder is connected to the carrier construction in at an end of the cylinder.

Preferable embodiments of the invention are set out in the dependent claims, to which reference are made.

The invention further relates to a method for transporting one or more boats or cargo devices from a parking area to a sea surface using the davit arrangement. The method comprises the following steps a) extending the cylinder arrangement in a first direction for positioning the davit arrangement in the storage position to retrieve a boat or cargo device from the parking area, retracting the cylinder in a second opposite direction and extending the davit arm further in the second opposite direction for positioning the davit arrangement in the launching position to lower the boat or cargo device to a sea surface.

The method for according to claim 8, wherein the method further comprises steps for repeating the steps for a second boat or cargo device.

The invention further relates to a method for transporting one or more boats or cargo devices from a sea surface to a parking area using the davit arrangement. The method comprises the following steps a) extending the davit arm in a second direction to position the davit arrangement in a launching position to hoist a boat or cargo device from the sea surface, retracting the davit arm and extending the cylinder arrangement in a first direction for positioning the davit arrangement in the storage position to lower a boat or cargo device in the parking area,

DETAILED DESCRIPTION OF THE INVENTION

There is defined three operational positions throughout the description;

A "launch position". In this position a davit arm with hoisting arrangement has been moved to a position in order to hoist the boat or cargo device down to the sea surface or up to be stored in the area in connection with the davit arrangement.

A "storage position" is defined as the position a cylinder arrangement is moved to a position in order to store a boat or cargo device in a storage area in connection with the davit arrangement.

A "intermediate position" is defined as the position between the two previous defined positions, before/after the launching and storage of the respective boats. The term "boat" is defined as any boat or similar devices adapted to be launch or parked by the davit arrangement. This may for instance be a lifeboat, or other similar boats that is suitable to be operated by the davit arrangement. The term "boat" also includes unmanned surface vehicle (USV), unmanned and manned autonomous underwater vehicle (AUV) and cargo. The invention further defines a first boat A and a second boat B. These refers to the order of sequence of the handling of the boats.

It is to be noted that instead of a boat, the davit arrangement may handle a cargo device. The description also includes this use even if not explicitly mentioned in the detailed description.

The term "parking area" is defined as the area where the boats are stored when not launched/hoisted to/from the sea surface.

The term "telescopic arrangement" refers to a telescopic arrangement having a carrier construction, a davit arm, one or more cylinders and a winch arrangement. The features will be described in detail below.

The term "one-point davit arrangement" refers to an arrangement having one contact point to the boat for the launching/hoisting operation, ie it comprises one telescopic arrangement. For simplicity, a single telescopic arrangement is referred to as a one-point davit arrangement hereinafter in the description.

The term "two points davit arrangement" refers to an arrangement having two contact points to the boat for the launching/hoisting operation, ie it comprises two individually or correlatedly operated telescopic arrangements. Each of the individually telescopic arrangements may have the same design as the one-point davit arrangement. The following description refers to the arrangement with combined two telescopic arrangements as "the two-points davit arrangement".

Figure 1:
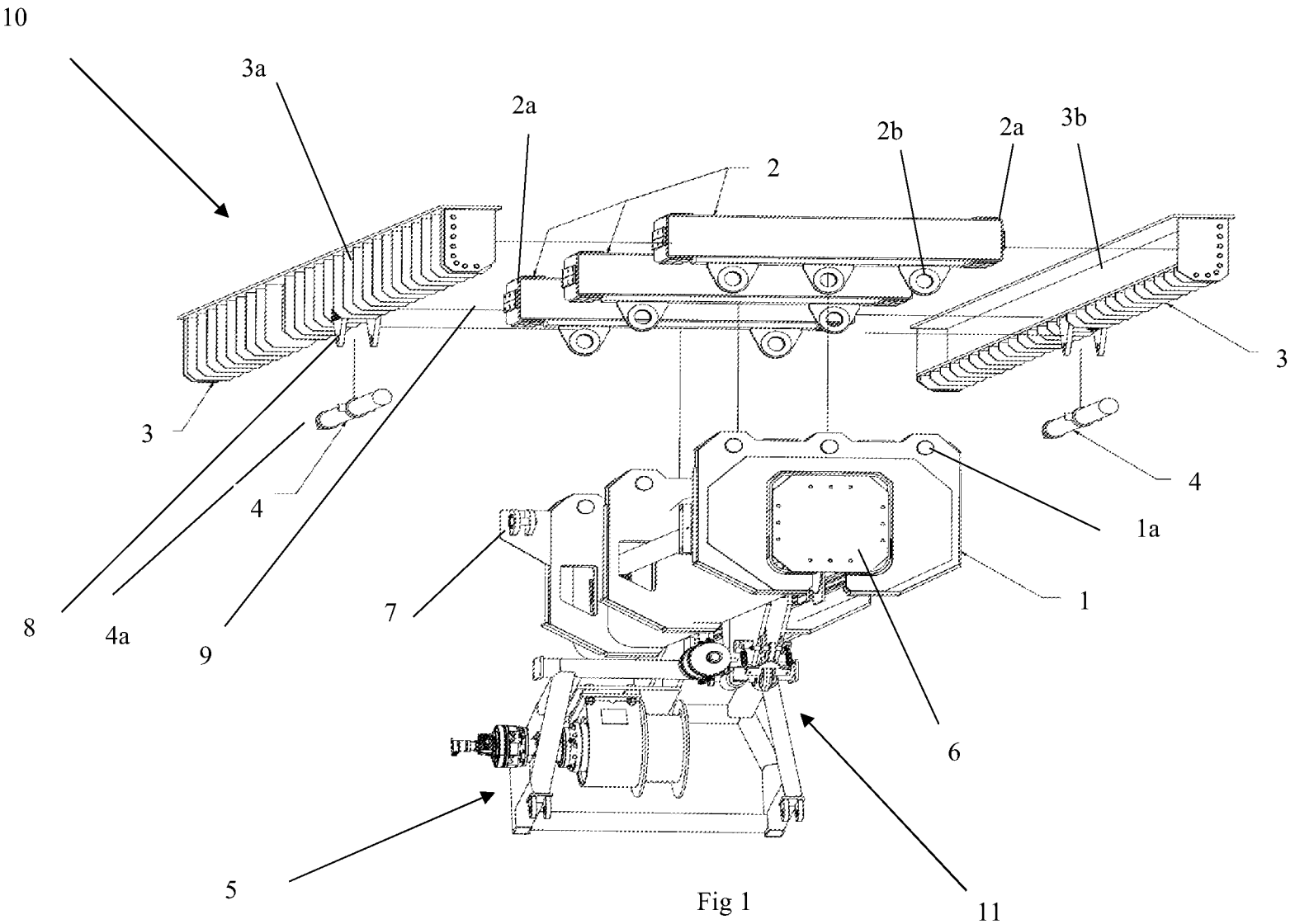
FIG. 1 shows an overview over the davit arrangement according to the invention, in an exploded view.

FIG. 1 shows a davit arrangement 10 according to the invention.

The davit arrangement in the figure is illustrating a one-point davit arrangement 10.

The davit arrangement 10 comprises a carrier construction 1, 2, a davit arm 6, a rail construction 3 and a cylinder arrangement 4 as shown in the figure.

The rail construction 3 is in the figure illustrated by two rails 3 arranged spaced apart and attached to a roof or other overhanging structure 9. Each of rail 3 may have a slot 3*b*. Each of the rail 3 may also have transverse bracing plates 3*a* as indicated in the figure. The rails 3 are arranged so that the slots 3*b* of each of the rails 3 is facing each other.

The carrier construction 1, 2 comprises several sliding parts 2 and a davit carrier 1. The number of sliding parts 2 being transversely arranged between the rails 3 so that each end 2*a* of the number of sliding parts 2 protrude into the slots 3*a* of the rails 3. The number of sliding parts 2 is adapted to slidingly move within the rails 3 in the longitudinally direction of the rails 3. The figure indicates three sliding parts 2. This number may however vary in different embodiments of the invention.

The davit carrier 1 of the carrier construction 1, 2 is suspended from the sliding parts 2. The davit carrier 1 and sliding parts 2 may for instance be connected through a bolted connection 1*a*, 2*b*. This is indicated in the figure by ears with openings 2*b* in the number of sliding parts 2 and in corresponding number of ears with openings 1*a* in the davit carrier 1. The davit carrier 1 may comprise several plates 1*b* corresponding the number of sliding parts 2. Each plate 1*b* is suspended from a respective sliding part 2. The number of plates 1*b* are however mutually connected to form a rigid structure underneath the number of sliding parts 2.

The davit arrangement 10 further discloses a winch arrangement 5. The winch arrangement 5 is suspended beneath the carrier construction 1, 2. The winch arrangement 5 is further connected to the davit arm 6 and is thus adapted to be movable related to the carrier construction 1, 2. The winch arrangement 5 is further adapted to be connected to a boat A, B for launching and/or hoisting this to and from a suspended position to a storage position or sea surface.

The davit arrangement 10 further comprises a shock absorber 11 in connection with the winch arrangement 5 and davit arm 6, to reduce the impact of forces acting on the davit arrangement 10. The shock absorber 11 is known per se.

The davit arrangement 10 further comprised a cylinder arrangement 4. In the figure is arranged a cylinder arrangement 4 on each side of the davit carrier 1. Each of the cylinder arrangements 4 are connected to each of the rails as illustrated in the FIG. 1.

In the following one of the cylinder arrangements will be described in detail.

The cylinder arrangement 4 comprises a cylinder 4 attached to the rail 3 through a bracket 8 as indicated in the FIG. 1. The bracket 8 may be fixedly connected or integrated in the rail 3. The figure indicates that the bracket 8 is arranged at the underside of the rail 3. The bracket 8 represents a fastening mechanism between the cylinder 4 and the rail 3 and may be performed in other ways than through a bracket 8.

The cylinder 4 is arranged in parallel with the rail 3. The cylinder 4 is at a distal end 4*a* connected to the davit carrier 1 through a second bracket 7. The second bracket 7 is further fixedly attached or integrated with the davit carrier 1. The cylinder 4 having at least one further cylinder 4*d*, 4*e* arranged within the outer cylinder 4*c*, the cylinders 4*c*, 4*d*, 4*e* being telescopically and slidingly connected as will be described further related to relevant figures. The number of telescopic cylinders within the outer cylinder 4*c* is not limited to 2. However, any suitable number is possible.

Figure 2:
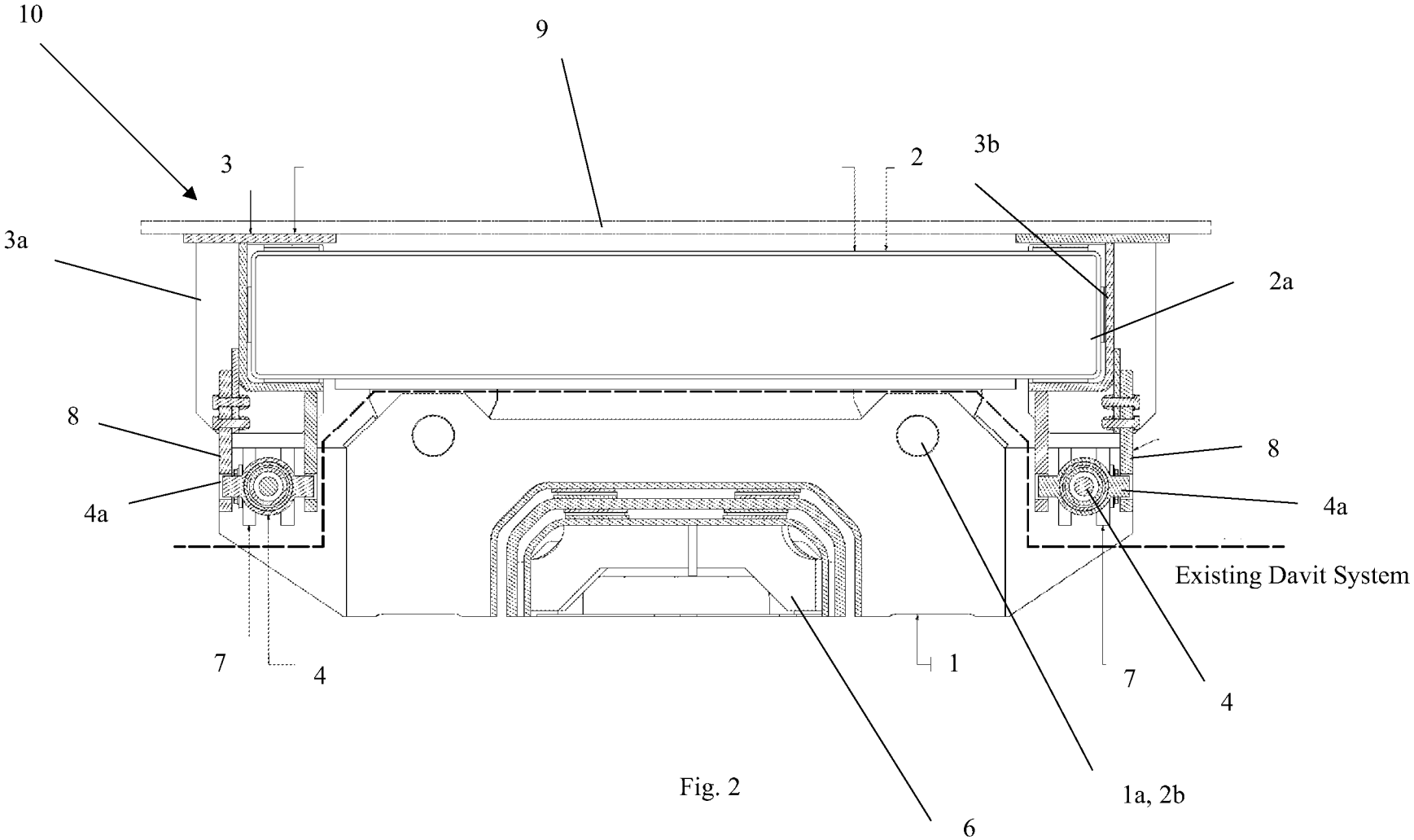
FIG. 2 shows a detail view of the davit arrangement according to the invention, viewed from behind.

FIG. 2 discloses a detailed view of the davit arrangement 10, viewed from behind. The figure illustrates how the different features described above, are connected together.

The davit carrier 1 with the davit arm 6 is suspended from the sliding part 2. On each side of the carrier 1, the cylinders 4 are positioned.

The cylinders 4 are suspended from the rails 3. The cylinders 4 are further connected in one end to the davit carrier 1 and in a second part to the rails 3 so that the telescopic cylinders 4 may slide the davit carrier 1 in the longitudinal direction.

Figure 3:
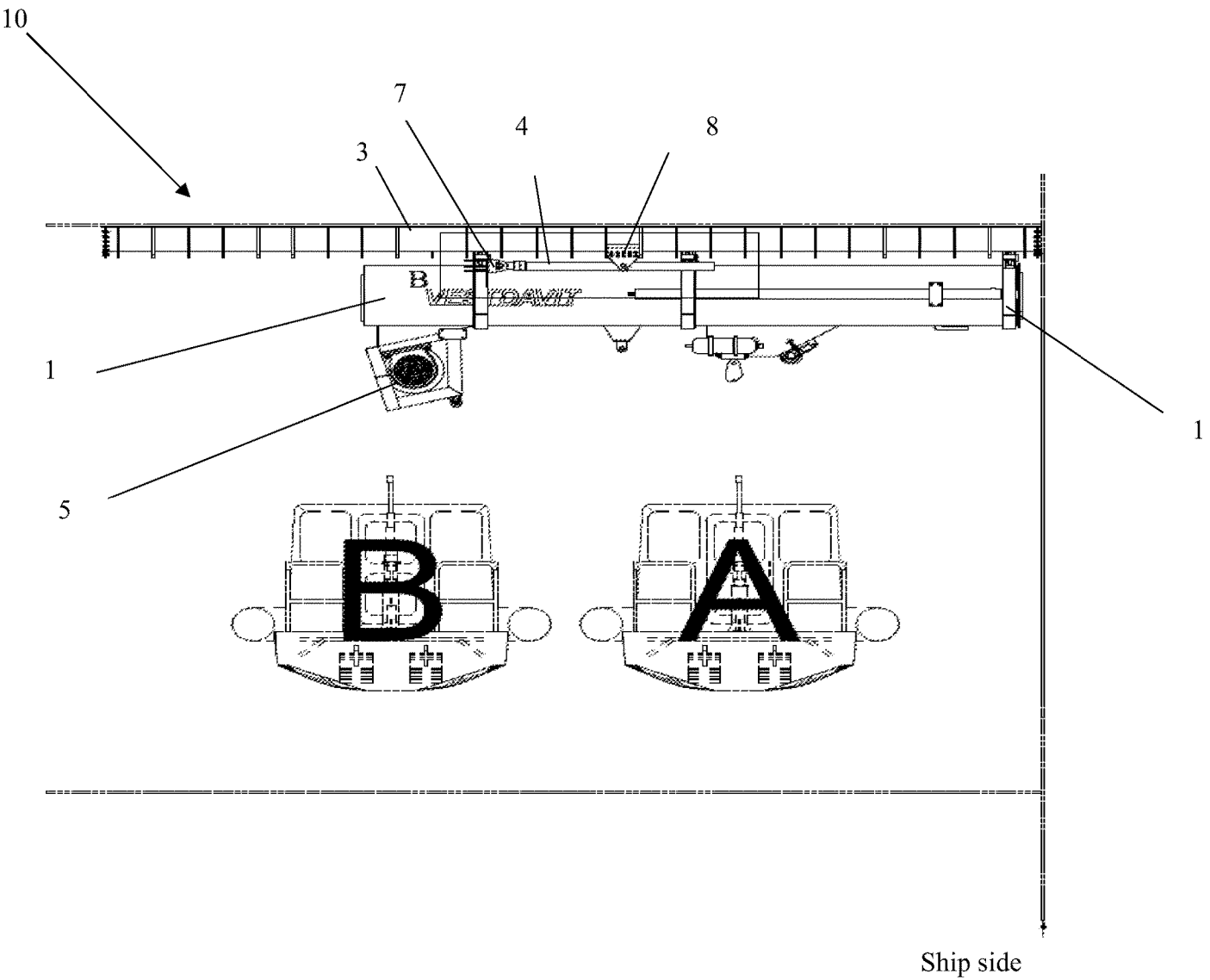
FIG. 3 shows a detailed view of the davit arrangement in the launch position of the cylinder.
Figure 4:
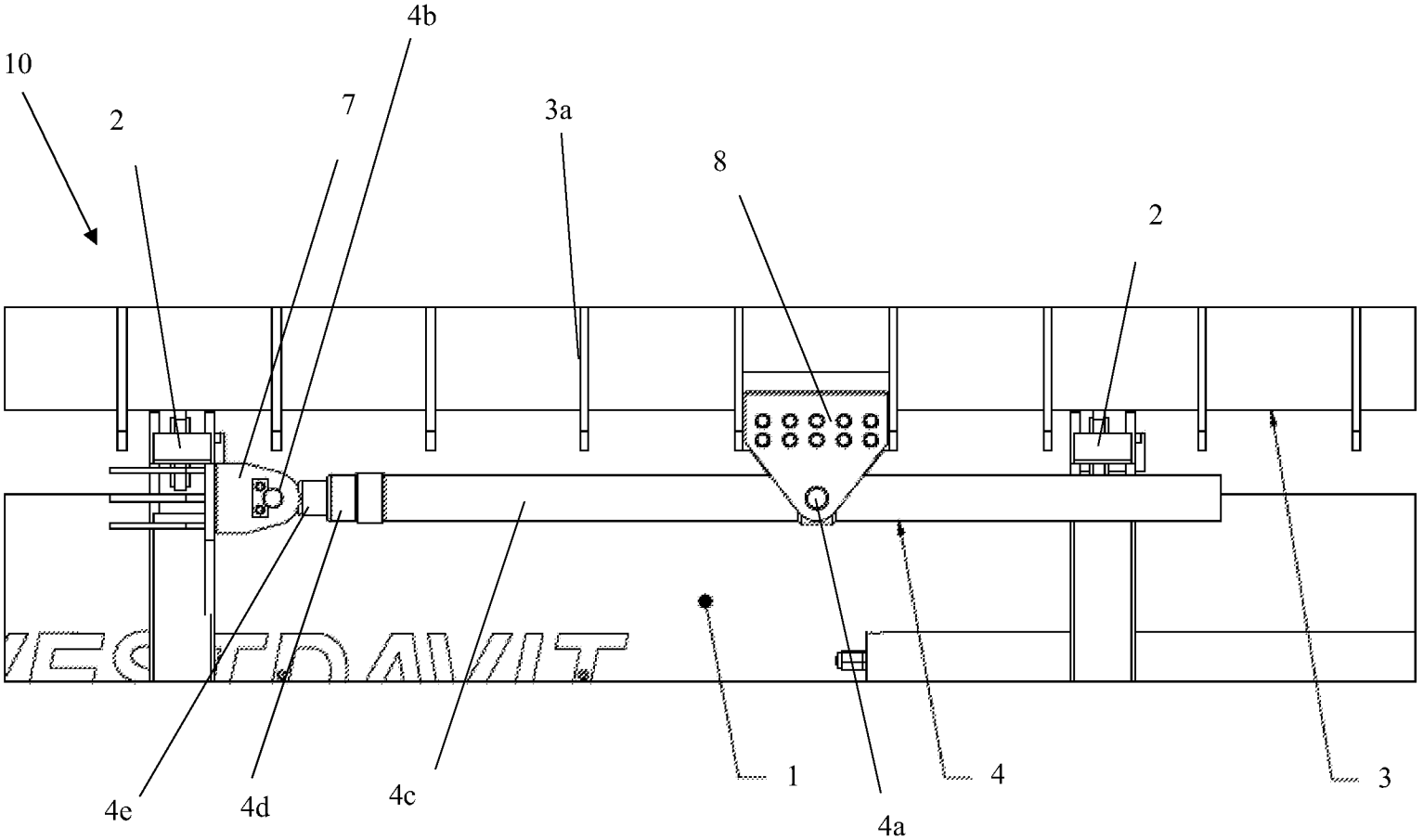
FIG. 4 shows a sectional view of the cylinder arrangement of the davit arrangement in the launch position.
Figure 5:
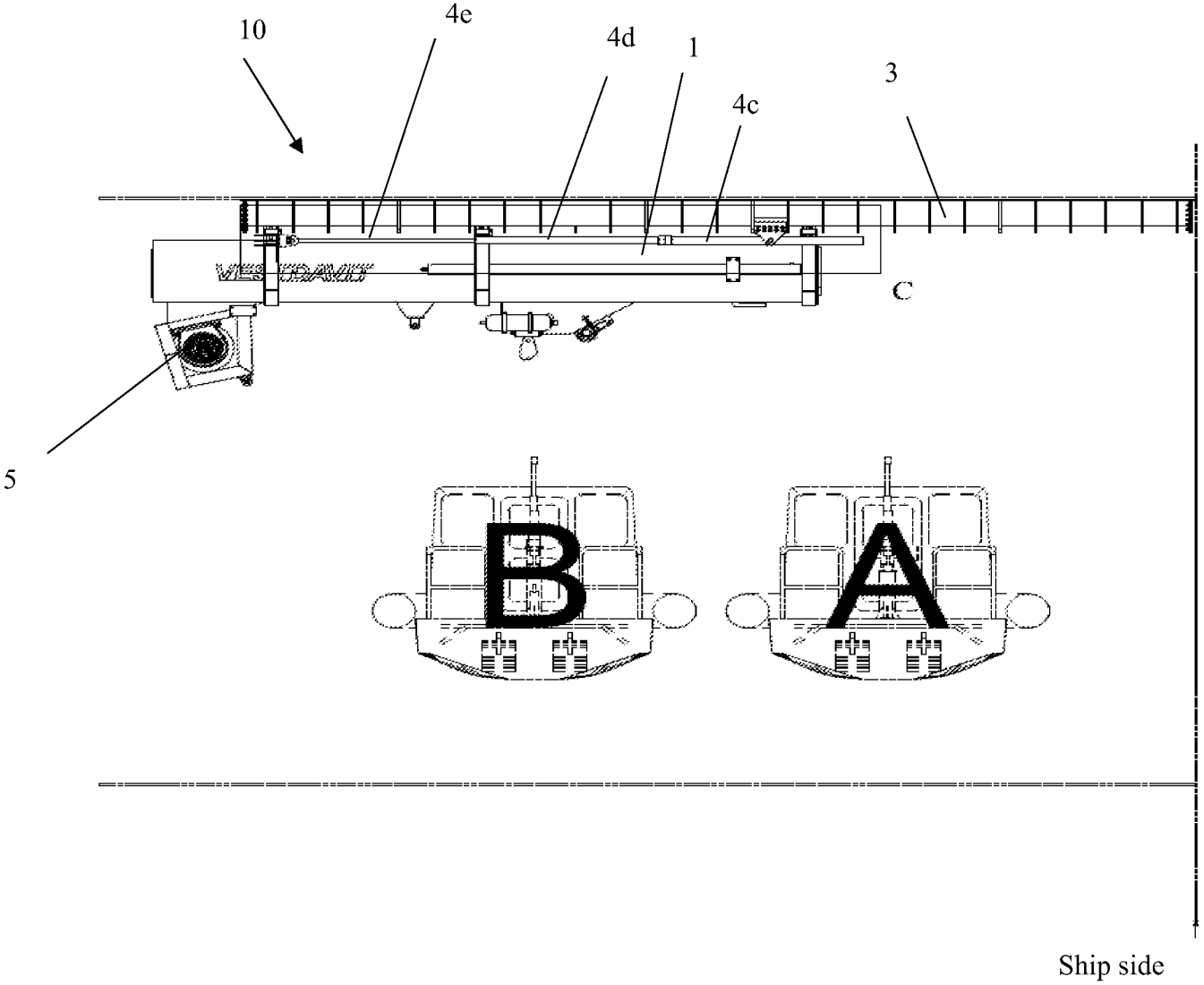
FIG. 5 shows a detailed view of the davit arrangement in the storage position of the cylinder.
Figure 6:
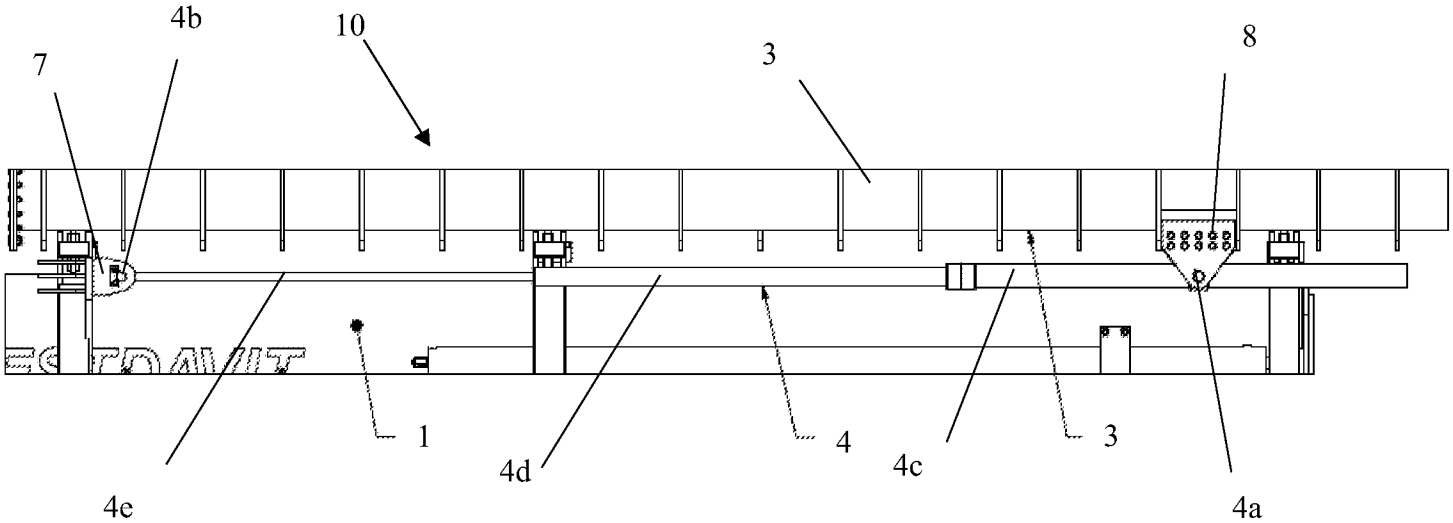
FIG. 6 shows a sectional view of the cylinder arrangement of the davit arrangement in the storage position.

FIG. 3-6 shows a detailed view of the cylinder arrangement 4 of the davit arrangement according to the invention, viewed from the side. The davit carrier 1 is arranged respectively in the intermediate position (FIGS. 3-4) and in the storage position (FIG. 5-6).

As seen particularly in FIGS. 4 and 6, the cylinder 4 comprises one or more cylinders 4*d*, 4*e* arranged within the outer cylinder 4*c*. The inner cylinder(s) 4*d*, 4*e* are thus slidingly arranged within the outer cylinder 4*c*.

As previously mentioned, the outer cylinder 4*c* is fixedly connected to the rail 3 through the bracket 8. It is indicated in the figures that the outer cylinder 4*c* is connected a distance from a free end of the outer cylinder 4*c*. However, the cylinder 4 may be connected in various positions to the bracket 8. It is also possible to connect the cylinder 4 to the rail 3 by other fastening arrangements than through a bracket 8, for instance a direct connection between the rail 3 and cylinder 4.

The innermost cylinder 4*e* is connected to the davit carrier 1 through the second bracket 7 as illustrated in the figure. This connection may also be performed by other connection arrangements than the second bracket 7, for instance a direct connection between innermost cylinder 4*e* and the davit carrier 1.

FIG. 3-4 illustrates the davit arrangement 10 in the intermediate position. In this position the davit arm 6 and the cylinder 4 is retracted in the most compact position. The inner cylinder(s) 4*d*, 4*e* is in this position arranged fully retracted into the outer cylinder 4*c*.

Beneath the davit arrangement, the two or more boats B and A that may be operated by the davit arrangement, is illustrated.

FIG. 5-6 illustrates the davit arrangement 10 in the storage position. In this position the cylinder 4 is extended in its full length by moving the inner cylinder(s) 4*d*, 4*e* out of the outer cylinder 4*c*. This movement will result in a movement of the davit carrier 1. As a consequence, the whole davit carrier 1 will move inwards, ie in the opposite direction of the davit arm 6. In this position, the boat may be lowered and stored in a parking area directly that is arranged to store the boats that are hoisted from the sea. The boats B, A are illustrating the boats that may be handled by the davit arrangement 10 to the parked/retrieved or launched/hosted.

FIG. 7-10 shows the functioning of the davit arrangement illustrated by a two-point davit arrangement.

Figure 7:
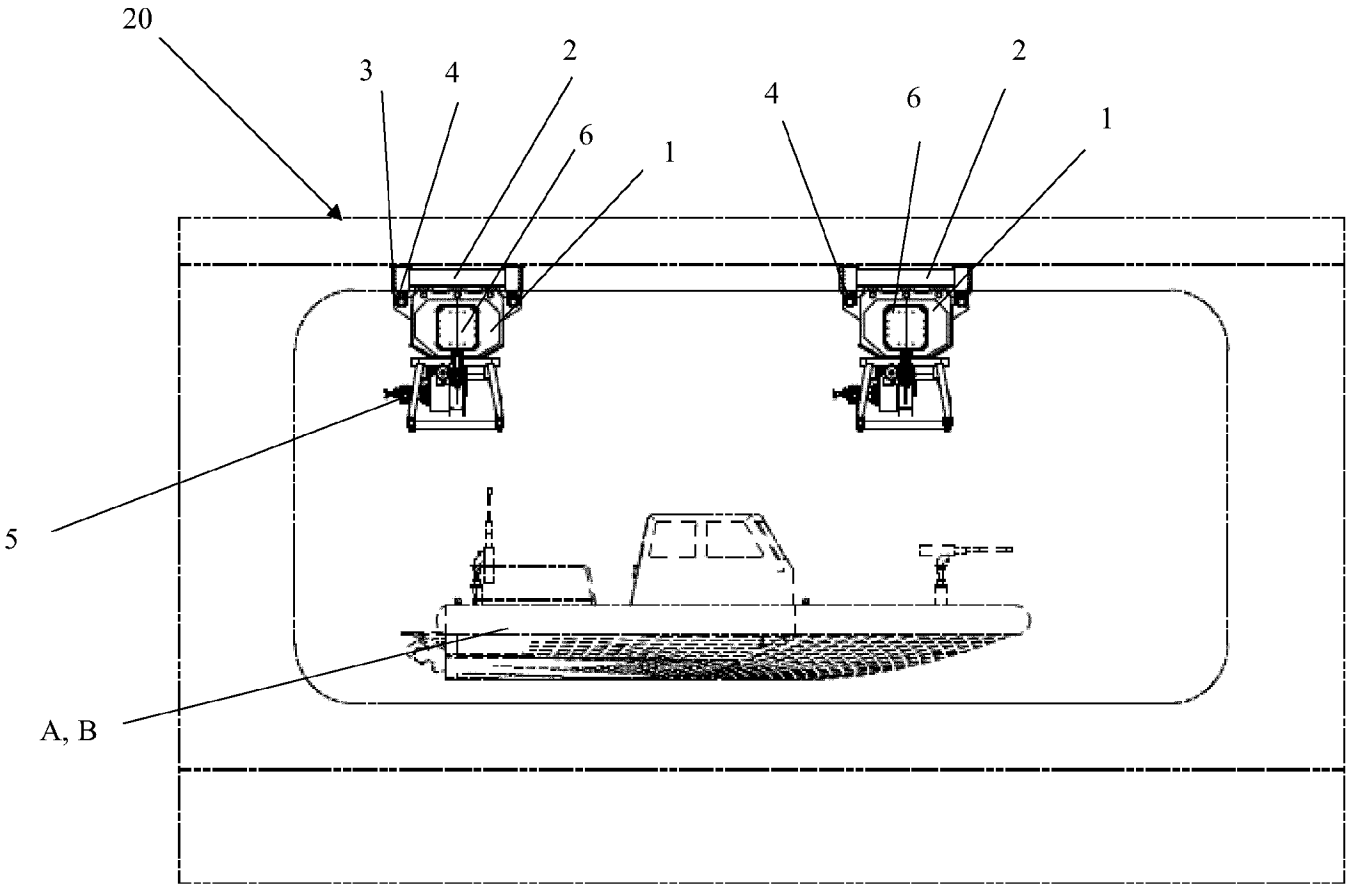
FIG. 7 shows the davit arrangement according to the invention from the side and illustrates the launching of a first boat A by the davit system.

FIG. 7 shows the two-point davit arrangement 20 made up by two telescopic arrangement. The figure shows the arrangement viewed in front of the arrangement, ie from the position where the boat(s) are launched into the sea.

Each of the telescopic arrangements comprises a davit carrier, sliding parts winch, beams and cylinders similar as described in relation to FIG. 1-6.

Figure 8:
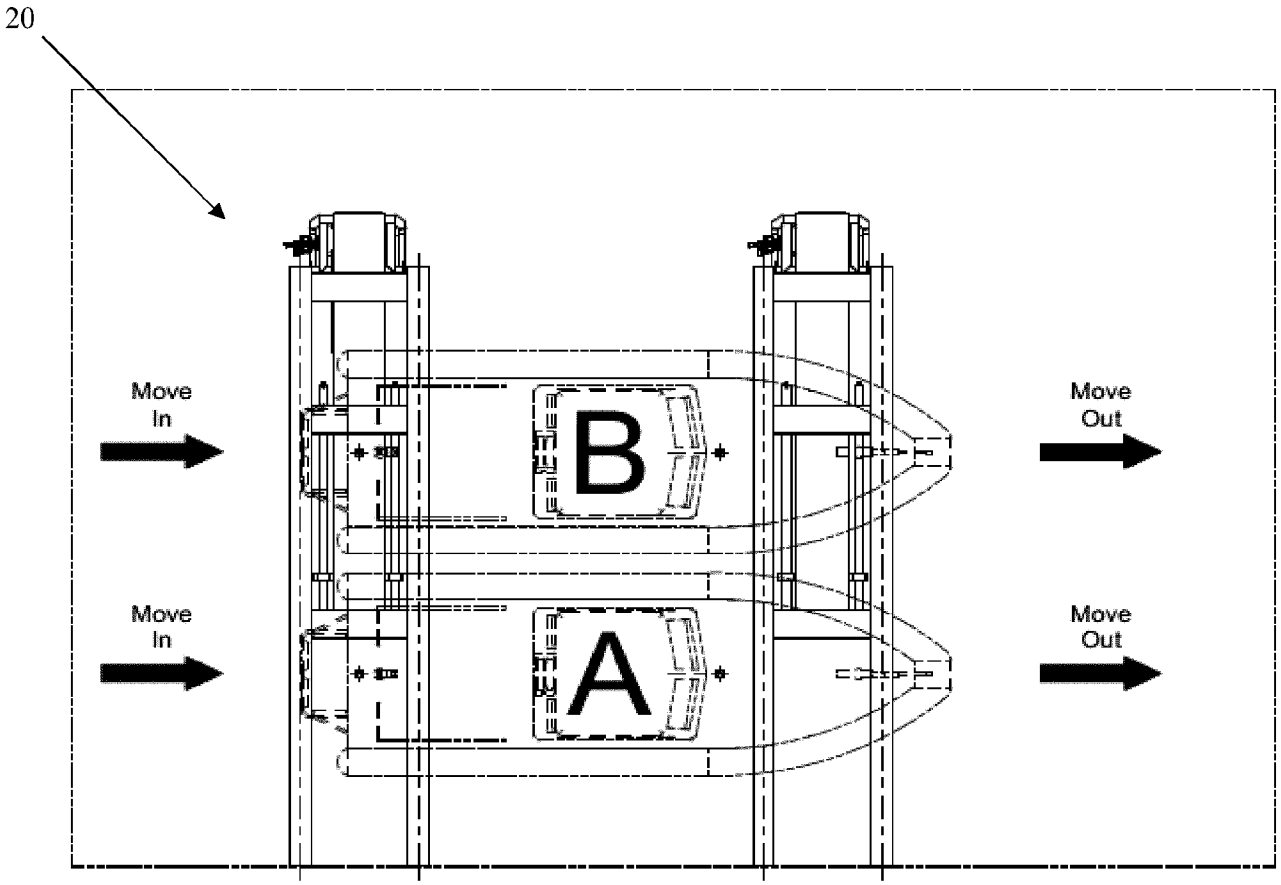
FIG. 8 shows the davit arrangement according to the invention from the side and illustrates the launching of a second boat B by the davit system.

FIG. 8 shows the two-point davit arrangement 20 viewed from above with two boats A, B arranged beside each other in the storage area beneath the davit arrangement 20.

Figure 9:
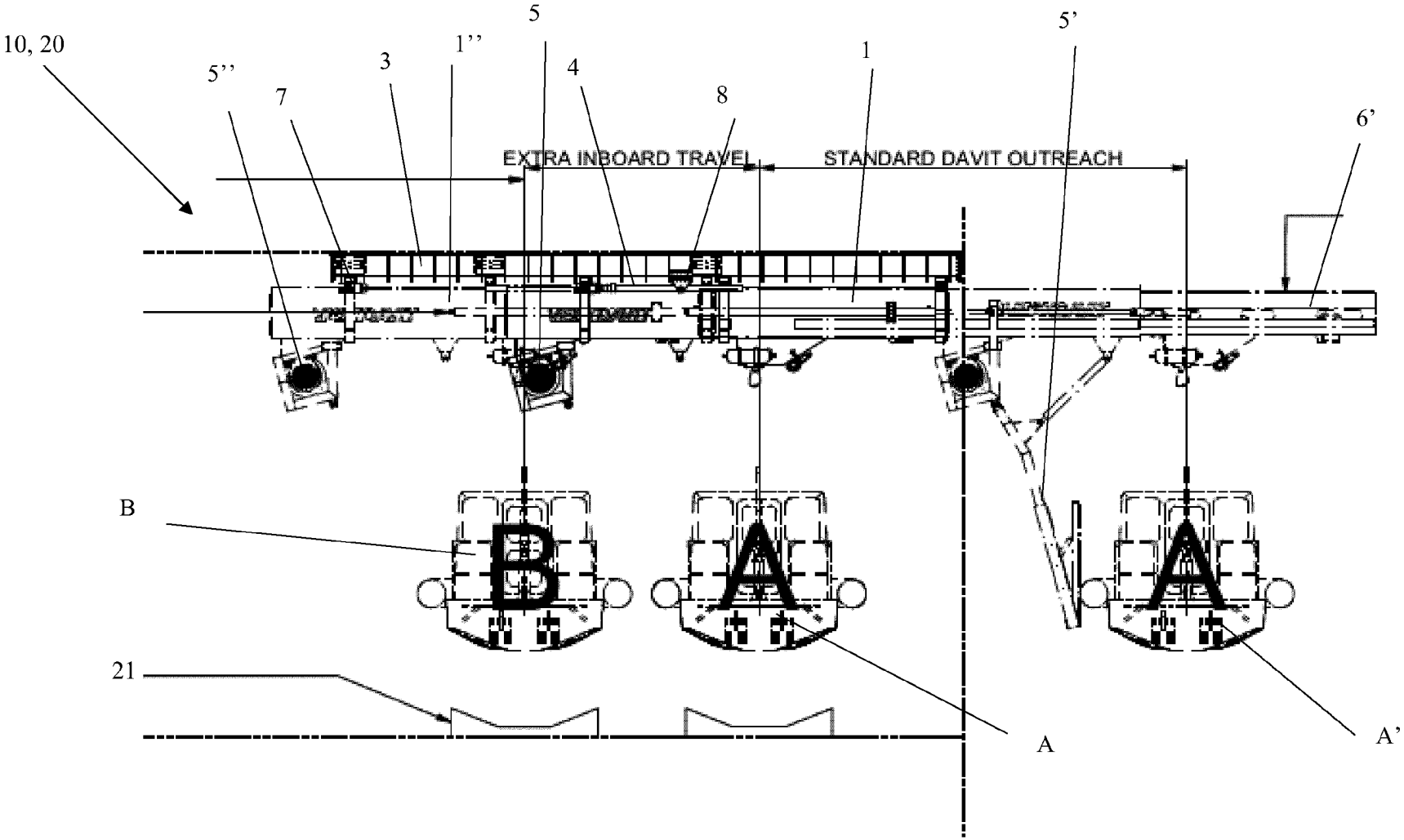
FIG. 9 shows a perspective view of the davit arrangement according to the invention, divided into components.

FIG. 9 illustrates all the three possible positions of the davit arrangement 10, 20 together in one figure. It is to be noted that this is not a correct image of the davit arrangement 10, 20 as the davit carrier 1 will move inwards when the cylinder 4 being extended. The figure thus illustrates only the different positions of the davit arrangement 10, 20.

To distinguish the features arranged in the innermost position and launching position from the intermediate position, the reference number of the winch arrangement and the davit carrier positioned in the storage position have been given the reference number 5" and 1". The boat, the winch arrangement and the davit arm positioned in the launching position have respectively reference number A', 5' and 6'. The features are the same features as the features with numbers 5, 1, A and 6, the difference is the positioning.

The figure shows how the davit carrier 1 is moved inwards facing away from the sea area. The boats may by this movement be transported inwards into different storage positions of the boats in the parking area directly. As indicated in the FIG. 9, the boat B may be lowered onto a boat crib 21 when parked or stored.

The figure indicates that the boat A is positioned and parked beside the boat B in a separate and similar boat crib 21 in the parking area. The boat A is arranged at the side facing the sea area.

In the launching operation, the boat A is hoisted from the crib 21 by the winch arrangement 5. The boat A is further transported to a launching position. In the launching position, the davit carrier 6' is extended to the outermost position as shown in the figure. The travelling distance for the boat from A to A' by the davit arm 6 is defined as the standard davit outreach. In this launching position, the boat A' is suspended above the sea surface and may be lowered into the sea by the winch arrangement 5' and released from the winch arrangement 5.

The davit arm 6 may then be retracted again into the davit carrier 1 until fully retracted. From this intermediate position, the cylinder(s) 4 may extend in the opposite end and move the davit carrier 1 inwards from the position indicated by reference number 1 to reference number 1", to position the winch arrangement 5 above the boat B or further inwards as indicated with reference number 5" to hoist a boat that is arranged in the parking area. The davit carrier 1 is adapted to move a distance referred to as the extra inboard travel in FIG. 9.

Figure 10:
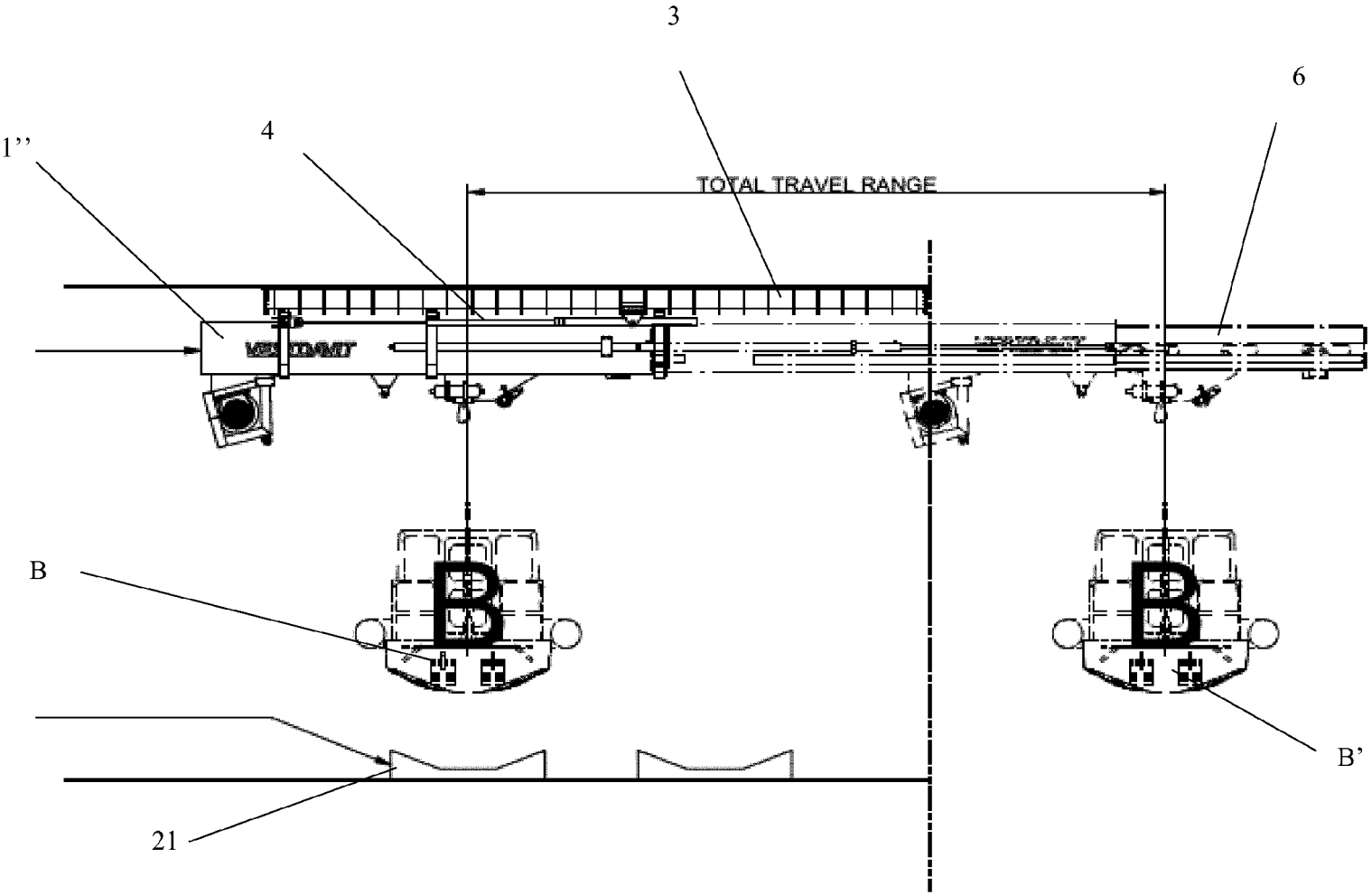
FIG. 10 shows a detailed view of the davit arrangement according to the invention.

FIG. 10 shows the steps repeated for boat B from the storage position to a launching position of the boat B.

The procedure will thus be that the one or more cylinder(s) 4 is moving the davit carrier 1 inwards by extending the cylinder(s) 4 as described above. The slidable part 2 attached to the davit carrier 1 is at the same time moved in the longitudinal direction of the beams 3. When the winch arrangement 5" is aligned with the boat B, the boat B is secured to the winch arrangement 5" and lifted from the crib 21. The cylinder(s) 4 is retracted in the opposite direction, resulting in a movement of the boat B towards the intermediate position where the cylinder(s) 4 is fully retracted. When reaching the intermediate position, the davit arm 6 is extended out from the davit carrier 1. When the davit arm 6' is fully extended, the boat B' is suspended above the sea surface. The boat B' may then be lowered into the sea.

By this davit arrangement 1, several boats may be lifted directly from their storage position one by one as described above and launched to the sea without any intermediate arranging of each boat.

The invention claimed is:

1. A davit arrangement for launching and storing one or more boats or cargo devices, the davit arrangement comprising:

a carrier construction slidingly connected to a rail construction, said rail construction is adapted to be fixedly attached to a roof or other overhanging construction;

a davit arm arranged slidingly connected to the carrier construction, said davit arm is adapted to move between a launching position where the davit arrangement is adapted to hoist the one or more boats or cargo devices to or from a sea surface, and an intermediate position where the davit arm is retracted into a position within the carrier construction of the davit arrangement;

a cylinder arrangement connected to the carrier construction at one end and connected to the rail construction at an opposite end, said cylinder arrangement adapted to move the carrier construction between the intermediate position and a storage position where the one or more boats or cargo devices is adapted to be stored, wherein the davit arm and the cylinder arrangement are respectively adapted to extend in opposite directions; and wherein the cylinder arrangement is adapted to move:

in a first direction for positioning to accommodate an extended position with the davit arrangement in the storage position to retrieve the one or more boats or cargo devices from a parking area; and a second opposite direction to a retracted position with the davit arm extended for positioning the davit arrangement in the launching position to lower the one or more boats or cargo devices to the sea surface.

2. The davit arrangement according to claim 1, wherein the cylinder arrangement comprises two cylinders parallelly arranged to the carrier construction.

3. The davit arrangement according to claim 2, wherein the two cylinders are arranged spaced apart, one on each side of the carrier construction.

4. The davit arrangement according to claim 1, wherein the cylinder arrangement comprises an outer cylinder adapted to be fixedly attached to the rail construction and at least one inner cylinder fixedly attached to the carrier construction, said outer cylinder and the at least one inner cylinder is slidingly arranged to each other.

5. The davit arrangement according to claim 1, wherein the carrier construction comprises a number of sliding parts extending in a transverse direction between two rails of the rail construction, wherein each end of the number of sliding parts being slidingly arranged in a longitudinal direction within the rails.

6. The davit arrangement according to claim 1, comprising two telescopic arrangements parallelly arranged for launching and storing the one or more boats or cargo devices having two points for winch connection.

7. The davit arrangement according to claim 1, comprising a winch arrangement connected to the davit arm, said winch arrangement is adapted to be connected to the one or more boats or cargo devices for launching and lifting the one or more boats or cargo devices to or from the sea surface.

8. A method for transporting one or more boats or cargo devices from a parking area to a sea surface using a davit arrangement for launching and storing the one or more boats or cargo devices, the davit arrangement comprising:

a carrier construction slidingly connected to a rail construction, said rail construction is adapted to be fixedly attached to a roof or other overhanging construction;

a davit arm arranged slidingly connected to the carrier construction, said davit arm is adapted to move between a launching position where the davit arrangement is adapted to hoist the one or more boats or cargo devices to or from the sea surface, and an intermediate position where the davit arm is retracted into a position within the carrier construction of the davit arrangement; and a cylinder arrangement connected to the carrier construction at one end and connected to the rail construction at an opposite end, said cylinder arrangement adapted to move the carrier construction between the intermediate position and a storage position where the one or more boats or cargo devices is adapted to be stored, wherein the davit arm and the cylinder arrangement are respectively adapted to extend in opposite directions, and wherein the cylinder arrangement is adapted to move in a first direction for positioning to accommodate an extended position with the davit arrangement in the storage position to retrieve the one or more boats or cargo devices from the parking area, and a second opposite direction to a retracted position with the davit arm extended for positioning the davit arrangement in the launching position to lower the one or more boats or cargo devices to the sea surface, the method comprising:

extending the cylinder arrangement in a first direction for positioning the davit arrangement in the storage position to retrieve the one or more boats or cargo devices from the parking area; and retracting the cylinder arrangement in a second opposite direction and extending the davit arm further in the second opposite for positioning the davit arrangement in the launching position to lower the one or more boats or cargo devices to the sea surface.

9. The method for according to claim 8, comprising steps for repeating the steps for a second boat.

10. A method for transporting one or more boats or cargo devices from a sea surface to a parking area using a davit arrangement for launching and storing the one or more boats or cargo devices, the davit arrangement comprising:

a carrier construction slidingly connected to a rail construction, said rail construction is adapted to be fixedly attached to a roof or other overhanging construction;

a davit arm arranged slidingly connected to the carrier construction, said davit arm is adapted to move between a launching position where the davit arrangement is adapted to hoist the one or more boats or cargo devices to or from the sea surface, and an intermediate position where the davit arm is retracted into a position within the carrier construction of the davit arrangement; and a cylinder arrangement connected to the carrier construction at one end and connected to the rail construction at an opposite end, said cylinder arrangement adapted to move the carrier construction between the intermediate position and a storage position where the one or more boats or cargo devices is adapted to be stored, wherein the davit arm and the cylinder arrangement are respectively adapted to extend in opposite directions, and wherein the cylinder arrangement is adapted to move in a first direction for positioning to accommodate an extended position with the davit arrangement in the storage position to retrieve the one or more boats or cargo devices from the parking area, and a second opposite direction to a retracted position with the davit arm extended for positioning the davit arrangement in the launching position to lower the one or more boats or cargo devices to the sea surface, the method comprising:

extending the davit arm in a second direction to position the davit arrangement in the launching position to hoist the one or more boats or cargo devices from the sea surface; and retracting the davit arm and extending the cylinder arrangement in a first direction for positioning the davit arrangement in the storage position to lower the one or more boats or cargo devices in the parking area.

* * * * *